US009217554B1

(12) United States Patent
Schertler

(10) Patent No.: US 9,217,554 B1
(45) Date of Patent: Dec. 22, 2015

(54) OPTICAL ELEMENT PROVIDING OBLIQUE ILLUMINATION AND APPARATUSES USING SAME

(71) Applicant: Donald J. Schertler, Rochester, NY (US)

(72) Inventor: Donald J. Schertler, Rochester, NY (US)

(73) Assignee: RPC PHOTONICS, INC., Rochester, NY (US)

( * ) Notice: Subject to any disclaimer, the term of this patent is extended or adjusted under 35 U.S.C. 154(b) by 118 days.

(21) Appl. No.: 13/768,746

(22) Filed: Feb. 15, 2013

(51) Int. Cl.

| | |
|---|---|
| ***F21V 5/04*** | (2006.01) |
| ***F21V 5/08*** | (2006.01) |
| ***F21V 7/10*** | (2006.01) |
| ***F21V 21/00*** | (2006.01) |
| ***F21V 21/30*** | (2006.01) |
| *F21V 7/00* | (2006.01) |

(52) U.S. Cl.
CPC ... *F21V 7/10* (2013.01); *F21V 5/04* (2013.01); *F21V 5/08* (2013.01); *F21V 21/00* (2013.01); *F21V 21/30* (2013.01); *F21V 7/0091* (2013.01)

(58) Field of Classification Search
CPC ..... F21V 5/007; F21V 5/008; F21V 5/04; F21V 5/043; F21V 7/0091; F21V 21/02; F21V 5/08; F21V 7/10; F21V 21/00; F21V 21/30
USPC ..... 362/145, 147, 244, 245, 327, 555
See application file for complete search history.

(56) References Cited

U.S. PATENT DOCUMENTS

| | | | | |
|---|---|---|---|---|
| 4,188,657 | A * | 2/1980 | Reibling | 362/348 |
| 4,954,935 | A | 9/1990 | Hammond et al. | |
| 6,481,130 | B1 * | 11/2002 | Wu | 40/546 |
| 6,497,500 | B1 * | 12/2002 | Bradford | 362/297 |
| 6,773,135 | B1 | 8/2004 | Packer | |
| 6,837,605 | B2 * | 1/2005 | Reill | 362/555 |
| 6,918,684 | B2 | 7/2005 | Harvey | |
| 6,976,765 | B2 | 12/2005 | Helenowski | |
| 7,033,736 | B2 | 4/2006 | Morris et al. | |
| 7,377,672 | B2 | 5/2008 | Tickner | |
| D580,565 | S | 11/2008 | Wilkinson | |
| D582,581 | S | 12/2008 | Wilkinson | |
| 7,481,557 | B2 | 1/2009 | Gaines et al. | |
| 7,726,847 | B2 | 6/2010 | Bingaman | |
| 7,896,522 | B2 | 3/2011 | Heller et al. | |
| 7,959,326 | B2 * | 6/2011 | Laporte | 362/249.02 |
| D673,719 | S | 1/2013 | Yeh | |

(Continued)

OTHER PUBLICATIONS

"Oblong." The American Heritage Dictionary of the English Language. Boston: Houghton Mifflin, 2011.*

*Primary Examiner* — Alan Cariaso
(74) *Attorney, Agent, or Firm* — Kenneth J. Lukacher Law Group

(57) ABSTRACT

An optical element is provided having an asymmetric body with a base cavity for receiving a light source, and outer sides providing total internal reflection, and a front face tilted so that the optical element's optical axis is at an oblique angle with respect to a target surface. Curvatures along cavity surfaces and outer sides are selected to output illumination from the body's front face having a distribution extending along the target surface's height and at least a portion of the width thereof having increased intensity with increasing height to provide at least substantially uniform illumination along the target surface's height. One or more optical elements may be in an apparatus, and multiple apparatuses may be disposed in front of one edge of a target surface and spaced from each other to provide the target surface with at least substantially uniform oblique illumination.

34 Claims, 15 Drawing Sheets

(56) References Cited

U.S. PATENT DOCUMENTS

| | | | | |
|---|---|---|---|---|
| 8,459,845 | B2 * | 6/2013 | Chang | 362/326 |
| 8,777,458 | B2 * | 7/2014 | Seki et al. | 362/332 |
| 2012/0039077 | A1 * | 2/2012 | Householder | 362/308 |
| 2012/0120666 | A1 * | 5/2012 | Moeller | 362/308 |
| 2012/0217897 | A1 * | 8/2012 | Gordin et al. | 315/294 |

* cited by examiner

OPTICAL ELEMENT PROVIDING OBLIQUE ILLUMINATION AND APPARATUSES USING SAME

FIELD OF THE INVENTION

The invention relates to an optical element that illuminates a surface at an oblique angle and does so such that the irradiance of the surface is uniform at least substantially over an area (e.g., height and at least a portion of width) of that surface, and apparatuses having the optical element and source(s) providing illumination thereto. The optical element of the present invention is useful for applications, such as illumination of a wall from a floor or ceiling position, architectural lighting, sign or billboard lighting, or any other application where the light source is not positioned directly in front of the object being illuminated, but must be located at an oblique angle to the surface or object to avoid obstructing the view of the surface. The optical element may utilize an LED source, but similar small sources may also be used.

BACKGROUND OF THE INVENTION

Typically, illumination of a roadside billboard sign is provided, for example, by 2 to 4 high-power metal halide lamps placed in separate fixtures at the base of the billboard sign a few feet out and pointed upward towards the board which may be 15 to 20 feet high and 40 feet or more wide. The lamp fixtures are typically separated from one another by ten to twelve feet. The resulting light distribution on the billboard (irradiance, or power per unit area) is poor and can vary by 6:1 or more, and will often exhibit an undesirable scalloped pattern at the base where, directly in front of the lights, the billboard is most brightly lit and between the lights the billboard is poorly lit. In addition, the irradiance along the height of the billboard is not uniform, decreasing significantly from the bottom to the top of the billboard.

Current billboard lighting systems utilizing a metal halide lamp have a reflector surrounding the backside of the lamp, and a window enclosing the unit. See, for example, U.S. Pat. No. 6,773,135 to Packer, and U.S. Pat. No. 4,954,935 to Hammond et al. Light from the lamp can take two paths before striking the billboard or vertical surface. The first is the direct path from the lamp, through the window to the billboard. The second is the reflected path in which light leaves the lamp, strikes the reflector, exits the window, and then strikes the billboard. In both Packer and Hammond et al. the window consists of a smooth area directly in front of the lamp, and a refractive prismatic-like structure along the periphery of the window. The refractive portion of the window captures some of the direct-path light and bends it toward the billboard. This light would otherwise miss the billboard if it were not refracted and bent by the prismatic structures of the window.

The reflector reflects the reflected-path light from the lamp and distributes it in a controlled fashion across a pre-defined region of the billboard. This may be done by faceting or shaping the reflector. The reflected-path light exits the fixture through the smooth area in the center portion of the window.

The center portion of the window is left smooth so as not to alter the path of the reflected light. But in doing so, the direct light passing through this center portion remains uncontrolled. This presents a problem. In general it is best to control all the light emitted from the lamp, both the direct-path light and reflected-path light to obtain the desired uniformity and light distribution across the billboard or vertical panel. Each point on the window passes both direct light and reflected light. If one tries to control the direct light by manipulating the structure of the center portion of the window, then one adversely affects the path of the reflected light. Conversely, if one tries to alter the path of the reflected light by manipulating the structure of the center portion of the window, then the direct light is adversely affected. Both paths cannot be controlled by the same structure. Although attempts have been made to control the reflected light by structuring the reflector and having a clear window, this allows much of the direct light to strike the billboard uncontrolled or even miss the billboard surface altogether, the consequence of this is that uniformity of the light distribution on the billboard is degraded. It has been found that currently used metal halide lamp systems despite such attempts have poor uniformity of a 6 to 1 variation of the light irradiance across the billboard. Thus, improved lighting apparatuses are needed to overcome the above problem and provide better uniformity of illumination over the entire area of a billboard, or other vertical surface requiring uniform oblique illumination to avoid obstructing the view of such surface from at least the front thereof.

Concerns about efficiency, light pollution, and other factors have manufacturers seeking alternatives to the current high intensity discharge (HID) lamps, such as LEDs. U.S. Pat. No. 7,896,522 to Heller et al. describes a front illuminated billboard using a linear array of LEDs stretching across the entire bottom of a panel to be illuminated. Some of the LEDs are fitted with lenses that are to illuminate a "top" area, others with different lenses to illuminate the "middle" and others that act as "fillers" which may or may not have lenses. The lenses are not designed for the oblique illumination of a billboard or vertical surface. Although useful to improve the overall efficiency for illumination of a billboard from that of HID lamps, the uniformity of this approach is even poorer in that the irradiance along the billboard varies from 12.6 footcandles to 99 footcandles, as stated by Heller et al., or a variation of nearly 8 to 1. It would thus be desirable to provide improved lighting apparatuses that cannot only provide more uniformity of illumination of a billboard, or similar vertical surface, but can utilize LED(s) rather than the typically used HID lamps.

SUMMARY OF THE INVENTION

Accordingly, it is an object of the present invention to provide an optical element to provide improved oblique illumination of a surface, such as a billboard, or other vertical surface, having more uniformity than the prior art.

It is a further object of the present invention to provide an optical element and using same to provide oblique illumination of a surface using small light source(s), such as LED(s).

It is another object of the present invention to provide an optical element that can be used in apparatuses having one or more optical elements that are positionable along the width of a surface, spaced horizontally and vertically from the bottom, top, or side edge thereof, to provide oblique angle illumination which is at least substantially uniform from upwards, downwards, or sideways, respectively, so as to appear uniform in illumination to human visual perception of such surface.

Briefly described, the optical element embodying the present invention has a body with a base cavity for receiving a light source, e.g., LED, and outer sides providing total internal reflection. The body is asymmetrically shaped having an optical axis extending through its base and front face, minor and major axes orthogonal to each other and to such optical axis, where the body is elongated along its major axis. The body is positionable by tilting the front face so that the body's optical axis is at an oblique angle with respect to a target surface, such as a billboard, or other surface desired to be obliquely illuminated.

Curvatures of surfaces along the cavity and the outer sides are selected to enable the body to output illumination from the front face having a distribution (or irradiance profile) upon the target surface, along the height of the target surface and at least a portion of the width of the target surface, which has increased intensity with increasing height to provide at least substantially uniform illumination of the target surface along at least the height thereof. Preferably, the base cavity of the optical element has curvature along its side walls and central portion surfaces. Light received by the body via the central portion is directed to the front face, and light received by the body via the side walls is reflected by the outer surfaces by total internal reflection to the front face.

Depending on the application, the distribution of the output illumination from the optical element can extend along the entire width of the target surface to illuminate over an entirety of the area of the target surface, or multiple optical elements are adjacently disposed in a direction along the width of the target surface to enable the distribution of the output illumination upon the target surface from adjacent disposed ones of the body to at least partially overlap and provide such substantially uniform illumination of an area of the target surface over a larger width of the target surface than provide by a single optical element. For example, the illumination distribution from the optical element along the horizontal direction maybe a Gaussian or bell-shaped, and adjacently disposed optical elements positioned so that their respective output illumination distribution falls to approximately one-half the peak value to overlap the one-half point of the output illumination distribution upon the target surface of the next adjacently disposed optical element to illuminate a larger area of the target surface with at least substantially uniform light. The number of optical elements used depends on the desire area to be illuminated as determined by the lighting application.

The optical element provides a distribution of output illumination from its body that has increased intensity along different portions at increasing height along the target surface in which the adjacent portions can partially overlap. This feature is provided by having curvature along the surface's outer sides, and surfaces of the cavity selected to control the amount (intensity) of light of the light source and its direction thereof from the front surface to different portions of the target surface along the height thereof. For example, a more distant portion of the target surface is provided with more light than more proximal portions of a target surface with respect to distance along body's front face from the target surface. In this manner, regardless of variation of the distance of the optical element with height of the target surface, illumination is made, almost if not entirely, uniform along such height.

One or more of the optical elements may be utilized in an apparatus (optical device, unit or fixture) where each of the one or more optical elements has its body internally illuminated by a different light source. When multiple optical elements are present in such apparatus, the distribution of output illumination from an apparatus along successive different portions of the width of the target surface at least partially overlap to illuminate the entire area of the target surface, such as described above.

The optical element's body is positionable at a distance from a bottom, top, or side edge of the target surface to provide a substantially uniform distribution of the output illumination at the oblique angle along one of the dimensions of the target surface of upwards, downwards, or sideways, respectively. In the above description of the optical element of the present invention, the term height represents one of such dimensions of the target surface aligned with the major axis of the optical element's body along the tilted front face thereof when the illumination is provided upwards or downwards; however, when the illumination is provided sideways the terms height and width are reversed where the width of the target surface now represents one of the dimensions aligned with the major axis of the optical element's body along the tilted front face thereof.

For example, in a billboard illumination application, multiple apparatuses with one or more optical elements are positioned where each apparatus is at a distance, e.g., 2 to 4 feet, below the bottom edge of the billboard and extending out about a distance, e.g., 6 feet, from the bottom of each optical element's front face. The number of optical elements of each apparatus is used to provide sufficient illumination to the billboard. For example, the optical elements may each be disposed in a one dimensional array or stacked in rows providing a two-dimensional array, as desired. Each billboard can be up to 48 feet wide or wider, and have multiple apparatuses spaced at even intervals, e.g., 4 to 12 feet apart, as needed depending on the area of the billboard each illuminates. Each apparatus will illuminate an area of the billboard directly in front of the fixture and overlapping the area illuminated by the adjacent apparatus to provide at least substantially uniform illumination of the billboard.

The apparatus further provides a method for illuminating a surface at an angle comprising the steps of: providing at least one asymmetrically shaped body having a cavity for a light source to provide light within the cavity, positioning the body at a distance from one edge of a surface so that the front face of the body is tilted with respect to the surface and provides an unobstructed view of the surface from at least a front of the surface, and the asymmetrically shaped body directs light from the light source when present along a dimension of the surface, and selecting curvatures of surfaces along the cavity and outer sides of the body to output illumination from the front face having a distribution upon the target surface extending along the height of the target surface and along at least a portion of the width of the target surface, in which the output illumination from the body has increased intensity with increasing height along the target surface to provide at least substantially uniform illumination of the target surface along at least the height of the target surface.

Although the target surface may be a billboard sign, or other vertical surface, the target surface may be flat or curved where light for illumination of such surface is desired that is off to one edge of the area of the target surface to be illuminated.

The optical element of the present invention may also be provided in an apparatus representing light fixtures for illumination of a vertical wall for architectural purposes, sometimes known as wall-washing.

The light sources preferably provide white light, but light sources may provide color light. Where multiple light sources and their associated optical elements are provided for illuminating a target surface or area, the light sources may be of different colors. Control of different ones of the light source thus can provide different color oblique illumination as desired.

The optical elements described herein can provide improved uniformity of oblique illumination with variation of intensity of less than 2 to 1 upon a target surface, which although substantially uniform can appear uniform in illumination to human visual perception of the target surface. This is in contrast with conventional approaches to oblique illumination, such as used for billboard illumination, which at best typically varies in intensity of 6 to 1 and thus can be noticeably non-uniform to the human eye, and can make poorly lit areas of the billboard more difficult to view.

BRIEF DESCRIPTION OF THE DRAWINGS

The foregoing objects, features and advantages of the invention will become more apparent from a reading of the following description in connection with the accompanying drawings in which.

DETAILED DESCRIPTION OF THE INVENTION

Figure 1A:
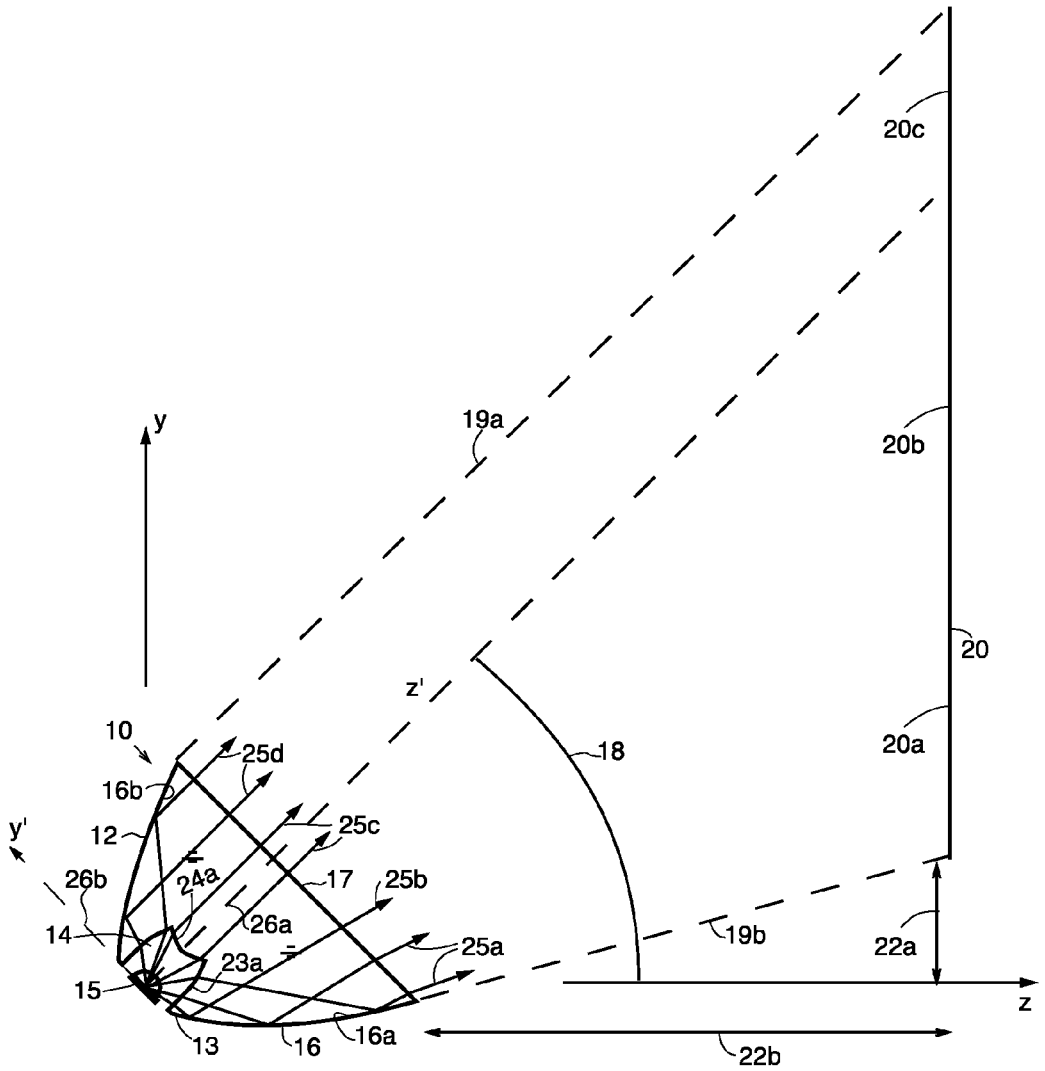
FIG. 1A is a cross-sectional view of an example of the optical element of the present invention relative to a target surface, such as a billboard, being illuminated, where the light is provided to the optical element from a light source.

Referring to FIG. 1, the optical element 10 of the present invention is shown having a body 12 with a base 13 having a cavity or recess 14 for receiving a light source 15, e.g., LED, outer sides 16 providing total internal reflection, and a front face 17. Body 12 is positioned above light source 15, such that the light source lies within the cavity 14 and is even or nearly even with the bottom of base 13. Front surface 17 is tilted to position the optical element 10 at an oblique angle 18 with respect to a target surface 20, such as a billboard, screen, wall, or other surface desired to be illuminated. The target output illumination from the optical element 10 extends between lines 19*a* and 19*b* upwards, i.e., to the top and bottom edges of surface 20. Lines 19*a* and 19*b* are defined as the viewing angle θ, as shown in FIG. 2. The body 12 is asymmetrically (or oblong) shaped about an optical axis z' (as opposed to being rotationally symmetric), and longer along the major axis y', than the minor axis x'. Axes x', y', and z' are orthogonal to each other and are also denoted as 26*c*, 26*b*, and 26*a*, respectively, in figures. Oblique angle 18 is between optical axis z' and a z axis, which extends from the optical element 10 in a horizontal direction that is orthogonal with a y axis along which extends the height of surface 20, where orthogonal axes x, y, z (see, e.g., FIGS. 2 and 5) are associated with the geometry of surface 20, and orthogonal axes x', y', z' are associated with the geometry of body 12.

The body 12 along axes z', y', and x' represents the thickness, height, and width, respectively, of optical element 10. At the light output end of body 12 is front face 17 along a plane parallel to the major and minor axes y' and x' of body 12. Front face 17 is elongated along the major axis y' due to the asymmetry (or oblong) shape of body 12 as best shown for example in FIG. 7B or 8C. The minor axis x' is not shown in FIG. 1A since this figure is a cross-section along the major axis y' and the optical axis z'. The optical element 10 is positioned so as to be offset by a vertical distance along the y axis, as denoted by arrow 22*a*, and a horizontal distance along the z axis, as denoted by arrow 22*b*. The oblique angle 18 may be varied by adjusting the tilt of front face 17 (and hence optical axis z' position) and distances 22*a* and 22*b* may be varied so that viewing angle θ of optical element 10 distributes illumination in an asymmetric fashion across the illuminated surface 20 along the entire height thereof and at least a portion of its width. As illustrated for example in FIG. 1A, the front face 17 along major axis y' (see FIG. 7B or 8C) faces a dimension aligned with the height of surface 20 that is parallel to axis y.

Figure 2:
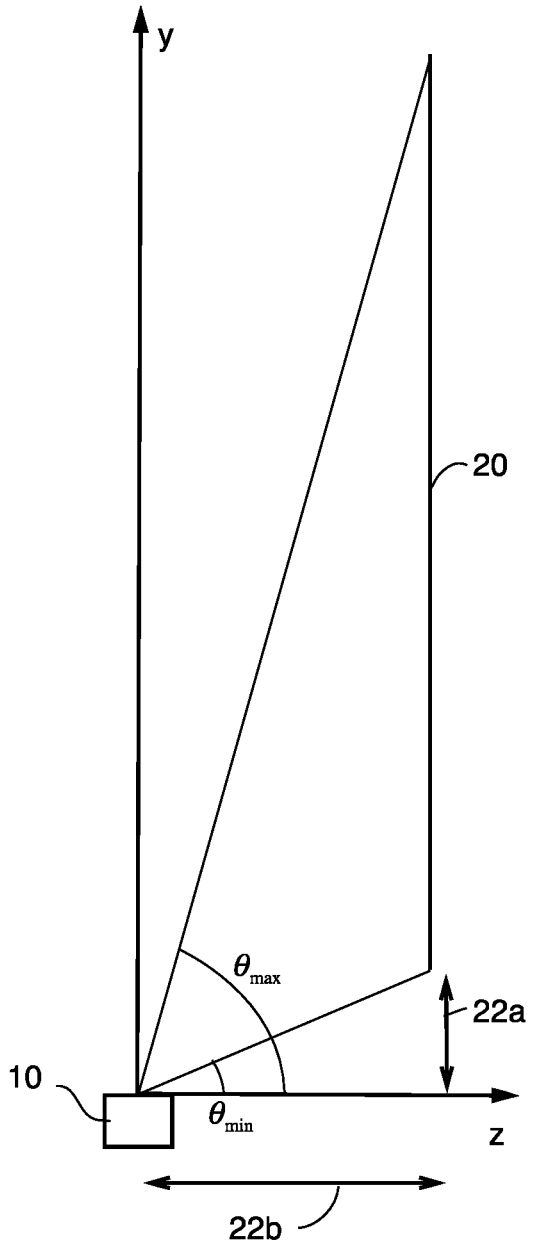
FIG. 2 is a diagram showing the geometry of illumination angles of the target surface and optical element of FIG. 1A.

FIG. 1A shows the relative relations of the components and is not a scaled drawing. In an example of surface 20 being a billboard of height 15 to 20 feet, the distance 22*b* of the optical element 10 to the billboard is typically 6 to 8 feet and the vertical displacement 22*a* is 3 to 4 feet. The optical element 10 itself will have height, width, and length dimensions typically on the order of 1 to 1.5 inches.

The body 12 of optical element 10 is of a solid, optically transparent material, such as plastic or glass, which may be molded to provide a selected shape of surfaces of walls 23, central portion 24, and outer sides 16 providing the desired illumination distribution to surface 20 in terms of the illumination's overall irradiance profile, as will be described in more detail below.

Figure 1B:
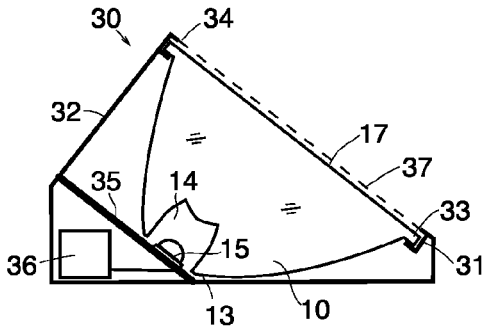
FIG. 1B is an example of an apparatus having the optical element of FIG. 1A.
Figure 1C:
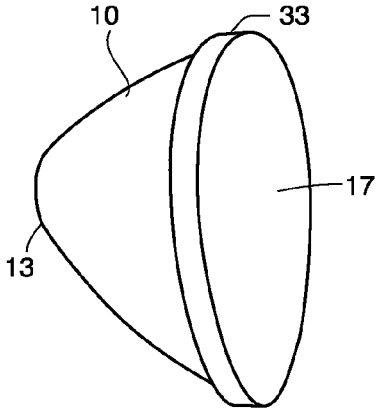
FIG. 1C is a perspective view of the optical element of FIG. 1A with a mounting flange.
Figure 1D:
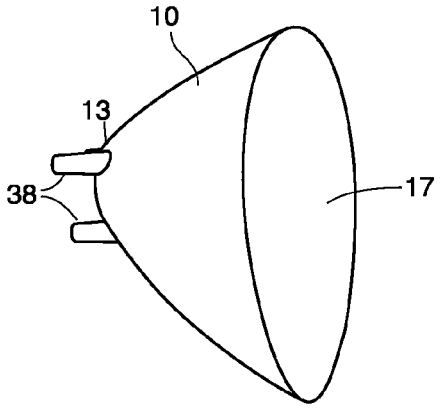
FIG. 1D is a perspective view of the optical element of FIG. 1A with mounting leg members.

One or more optical elements 10 and their associated light sources 15 may be part of a variety of different apparatuses 30. FIG. 1B shows an example of apparatus 30 having a single optical element 10. Optical element 10 is mounted in housing 32 by a mounting flange 33 extending around the front of body 12 being and received in a mounting fixture, such as a slot 31, about an opening 34 of housing 32. This positions the optical element 10 so that light source 15 is disposed within base cavity 14 just inside the entrance thereof central along optical axis z'. The optical element 10 with flange 33 is also shown in FIG. 1C.

Light source 15 is preferably a small, wide-angle light source, such as an LED as shown in the figures. The LED may be mounted in apparatus 30 upon a circuit board 35 having electronic circuitry for enabling LED operation. The LED for example may be of a high intensity type, such as providing 1000 lumens of white light, as for example a CREE XM-L LED. Electronic circuitry on circuit board 35 may be per specifications of the LED manufacturer. Such circuitry may be powered by a battery 36, or external power supply. An optional window 37, such as of transparent optical material (e.g., plastic of glass) may also be provided to serve as a cover to the front of the apparatus 30 to enclose optical element 10 and other components within housing 32. Other optical element 10 mounting mechanisms may be used than flange 33, such as by providing leg members 38, such as three in number, extending from the base 13, in which a mounting fixture is provided in housing 32 to capture such leg members (see FIG. 1D).

Figure 1E:
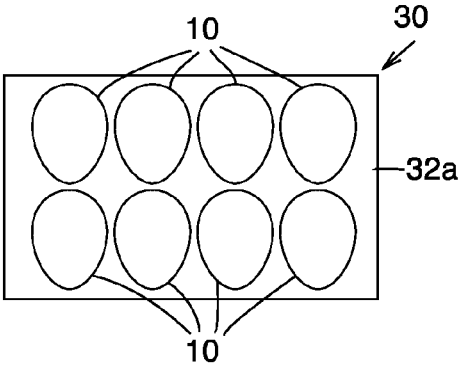
FIG. 1E is a front view of an example of an apparatus having a two-dimensional array of the optical elements of FIG. 1A.
Figure 1F:
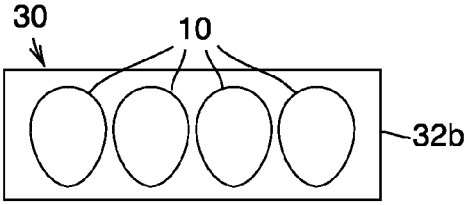
FIG. 1F is a front view of an example of an apparatus having a one-dimensional array of the optical elements of FIG. 1A.

Examples of apparatuses 30 with multiple optical elements and associated light sources are shown in FIGS. 1E and 1F. FIGS. 1E and 1F show a front view of a two dimensional array, and a one dimensional array of light sources 10 in a housing 32*a* and 32*b*, respectively. Other orientations and number of optical elements 10 may be used to provide the desired illumination to surface 20. Preferably, each of the optical elements is identical in shape, size and function. The optical elements may be randomly disposed in pattern with a common tilt of their front faces 17 or in a one or two dimensional array. Other configuration of apparatus 30 may be used to support optical element(s) 10 and associated light source(s) 15 with at least LED circuitry to support operation/control of the light source, as desired. Other light sources 15 may be used than an LED to provide white light.

Each light source 15 in apparatus 30 preferably provides white light, but may provide light of other color, or where multiple light sources are present may provide different color light. Circuitry within or connected to apparatus 30 can operate apparatus 30, and where multiple colors are present control different ones of the light sources to provide different color light illumination to surface 20 as desired.

The optical design of optical element 10 will now be described. As shown in FIG. 2, optical element 10 may be mounted several feet below the bottom edge of the area of surface 20 to be illuminated along the y axis (see arrow 22*a*), and out several feet in front of the vertical plane of the surface 20 along the z axis (see arrow 22*b*). Optical element 10 is illustrated in FIG. 2 as a block, but such block may also be considered apparatus 30. For purposes of illustration, surface 20 is considered a billboard, but the optical design can be utilized for any oblique illumination application. The lower edge of the area to be illuminated is at an angle $\theta_{min}$ above the horizontal to optical element 10. The top edge of the area of surface 20 to be illuminated is at an angle $\theta_{max}$ above the horizontal. It is between these angles that light is to be projected from the optical element 10 to provide at least substantially uniform illumination is terms of irradiance (power per unit area) distribution across surface 20 with minimal light outside this vertical range to minimize wasted light and light pollution. This geometry dictates that the intensity of the light from optical element 10 should follow a $1/\cos^3\theta$ dependence for the angle $\theta$ between $\theta_{min}$ and $\theta_{max}$ as measured from the horizontal z axis. The intensity of the light should fall off quickly outside this vertical range. As an example, the illumination angles for a 16 foot high billboard surface illuminated by an optical element 10 that is 3 feet below the bottom edge (see arrow 22*a*) and 6 feet out in front of the surface 20 (see arrow 22*b*) are about 25° for $\theta_{min}$ to about 75° for $\theta_{max}$. This same analysis can be applied to side or top illuminated surfaces with the appropriate change of orientation.

Figure 3A:
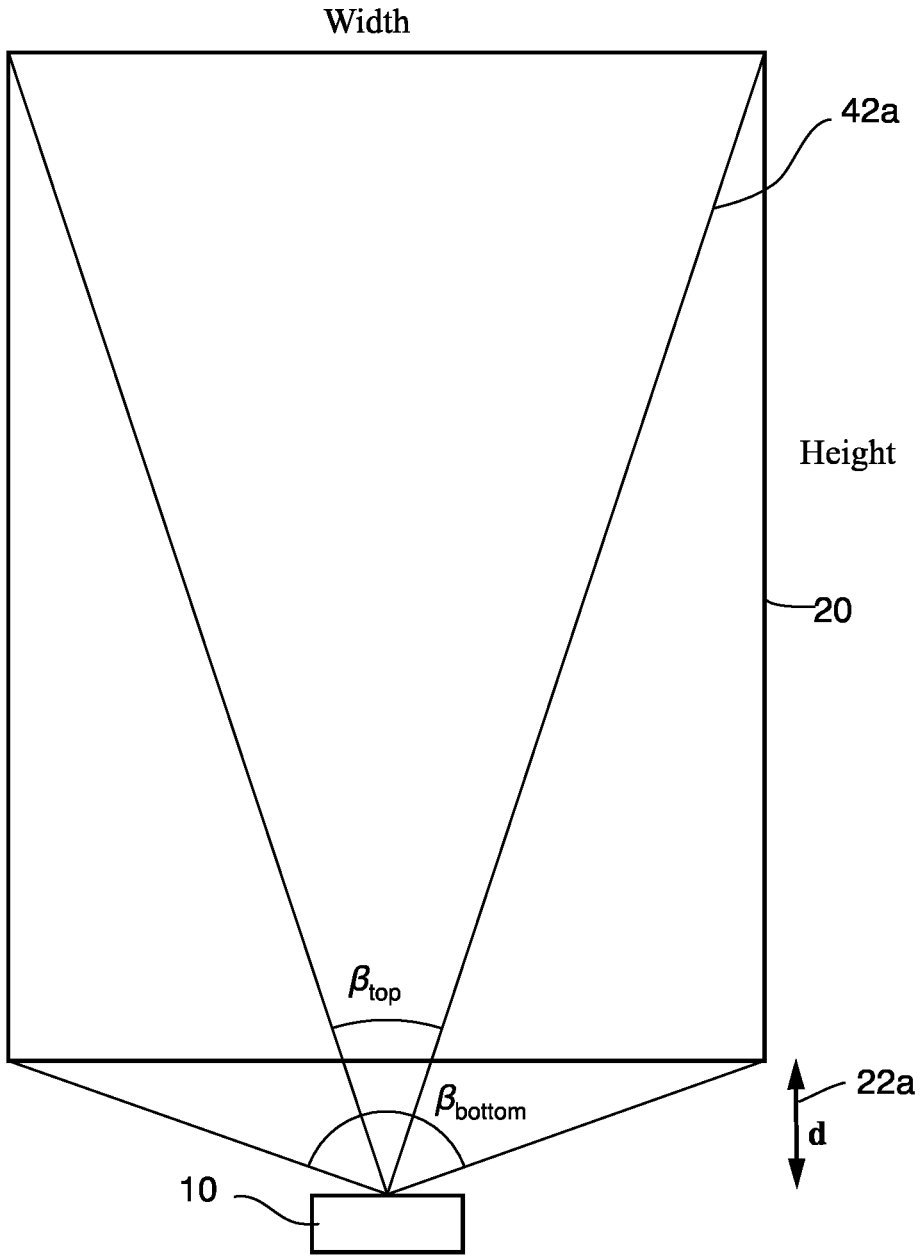
FIG. 3A is a diagram showing the geometry of illumination angles taken from the front view of the target surface and optical element of FIG. 1A.
Figure 3B:
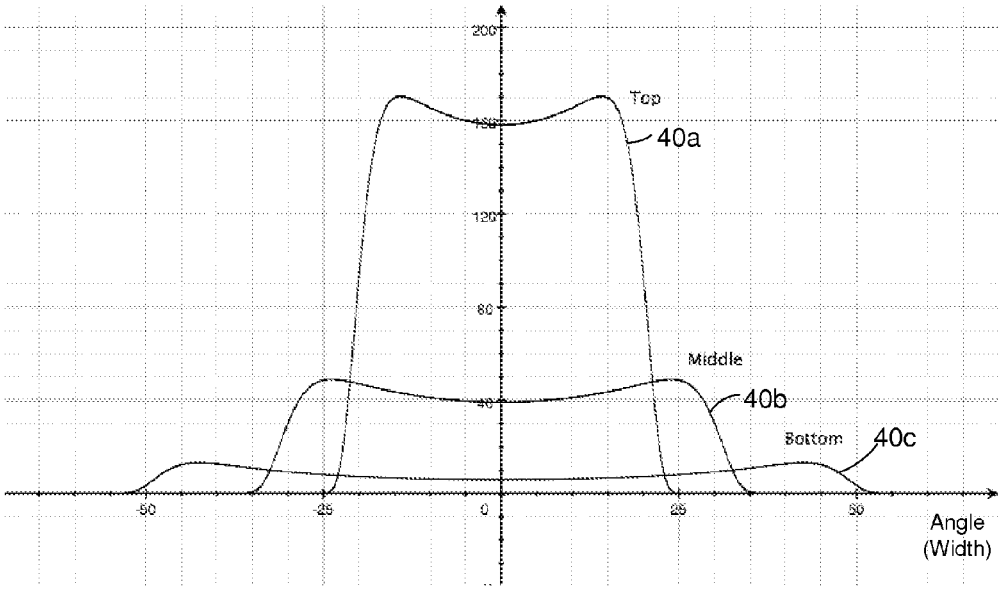
FIG. 3B is a graph showing the intensity distributions versus angle (degrees) at top, middle, and bottom of the target surface using a single optical element of FIG. 1A to illustrate the distribution of illumination outputted from the optical element upon the target surface.

Referring to the front view shown in FIG. 3A, the horizontal spread of the light from optical element 10 is much greater at the bottom of the surface 20 than at the top. Optical element 10 distributes the light across the surface 20 in a narrow horizontal angular spread toward the top of the illuminated surface 20 and a wider horizontal angular spread toward the bottom in order to cover the entire surface 20. In addition, since the top of the illuminated surface 20 is farther from the optical element 10, the optical element 10 projects more light at the top than at the bottom. FIG. 3B shows the intensity distribution curves (power as a function of angle) for the light projected toward the top (curve 40*a*), middle (curve 40*b*), and bottom (curve 40*c*) of the surface 20 to provide at least substantial uniform irradiance across the illuminated surface 20. Thus, the surface curvatures along sides 16, side walls 23, and central portion 24 collect substantially all the light from the light source 15 to provide from front face 17 output illumination having an irradiance profile along the top, middle, and bottom portions upon surface 20 so that increased intensity occurs with increasing height to uniformly illuminate at least substantially the surface along its height at oblique angle 18.

Consider a surface 20 that is 16 feet tall and 12 feet wide. For the optical element 10 when placed 3 feet below the bottom edge of surface 20 and 6 feet out from the surface 20, the angle subtended across the top of surface 20 is about 33° (±16.5°, and across the bottom is 84° (±42°. Each of these curves 40*a*, 40*b*, and 40*c* has more light that must be projected toward the edges of the surface 20 than at the center for any given horizontal slice through the surface 20. The combination of curves 40*a*, 40*b*, and 40*c* provides an irradiance profile of illumination that is almost, if not entirely, uniform along the entire vertical height of surface 20 over a given width of surface 20. For example, such irradiance profile may be uniform in width but other profiles also may be used.

In one case, the irradiance profile 42*a* of the output illumination from optical element 10 may extend along the entire width of surface 20, as shown for example in FIG. 3A, and thus over an entirety of the area of such surface. The horizontal variation of the irradiance from the fixture has a flat, almost if not entirely, uniform distribution over a defined area both horizontally and vertically. This is useful for vertical surfaces that are narrow and can be illuminated by an apparatus 30 having a single optical element 10, or a single apparatus 30 having multiple optical elements 10 such as shown, for example, in FIGS. 1E and 1F.

In other cases, the surface is much wider, and thus the output illumination from a single optical element 10 may extend along a portion of the width of surface 20. To address this, multiple optical elements 10 are disposed in their associated apparatus 30 adjacently in a one-dimensional array spaced the same offset in vertical and horizontal distances from the bottom of surface 20 to enable the illumination distribution upon surface 20 from adjacent disposed optical elements 10 to overlap at least partially and to illuminate an area of the target surface over a larger width of the target surface than is provided by a single one of the body, and preferably sufficient apparatuses 30 are provided to illuminate the entire area of surface 20.

Figure 4A:
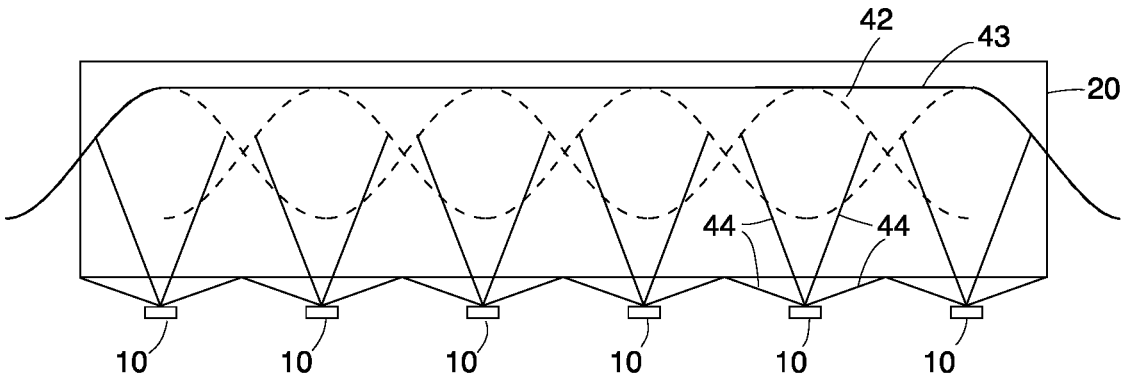
FIG. 4A is a schematic diagram of FIG. 1A showing the distribution (or irradiance profile) of illumination output of FIG. 3B for multiple optical elements evenly spaced in front of the target surface, where the dashed curves represent the light distribution from individual optical elements, and the solid curve is the total, summed distribution of adjacent optical elements.
Figure 4B:
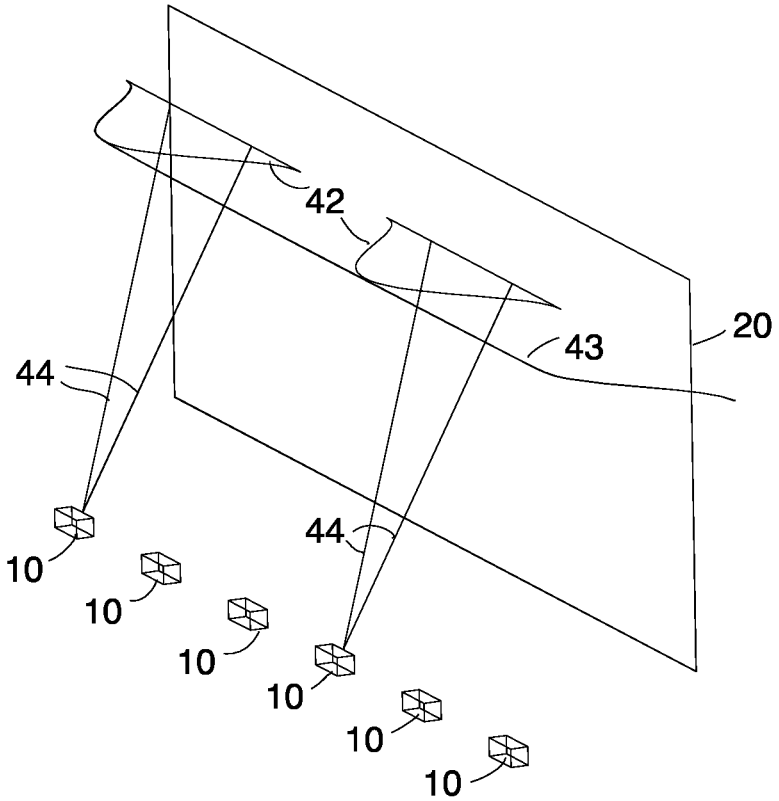
FIG. 4B is a perspective view of FIG. 4A showing that the summed distribution is uniform along the target surface.
Figure 5:
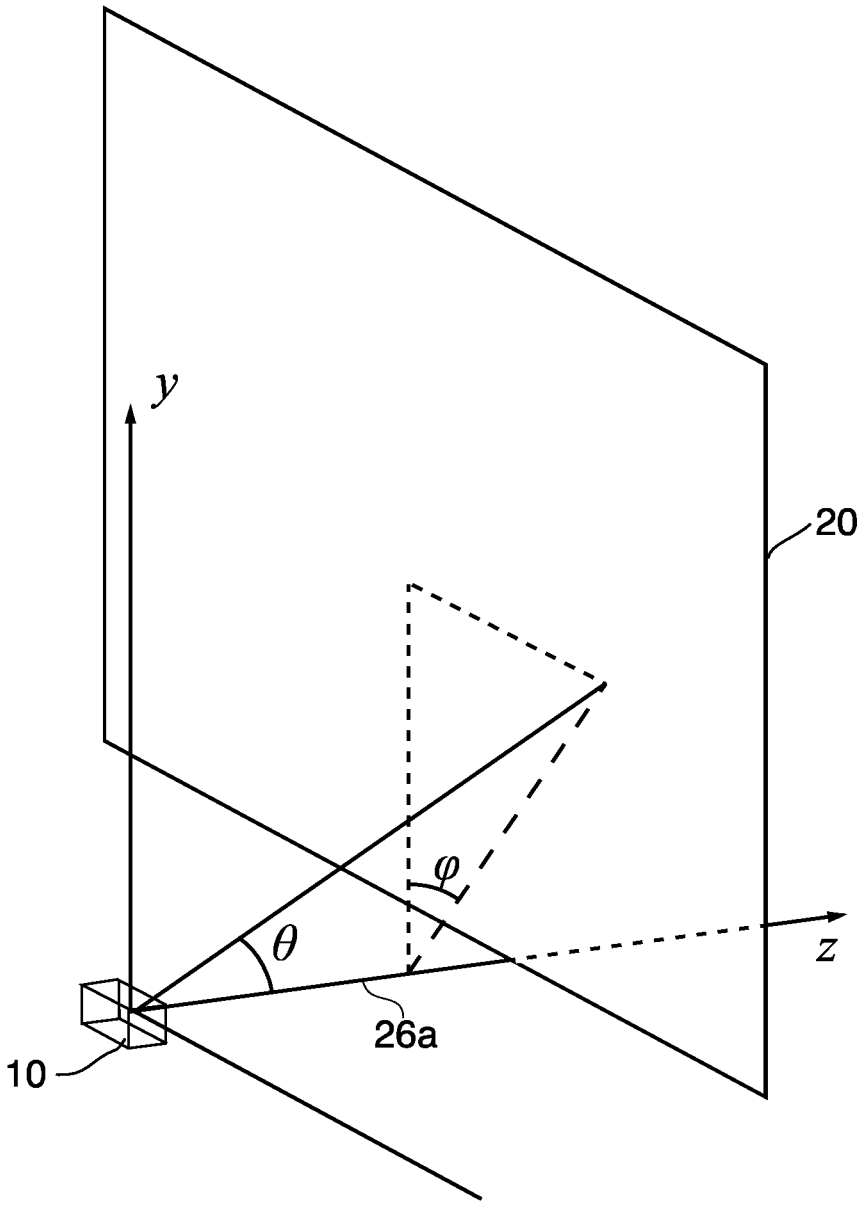
FIG. 5 is a perspective view showing the geometry of illumination angles of the target surface and optical element of FIG. 1A.

Consider an example of the surface 20 being a wide billboard or vertical surface 20 having multiple optical elements 10, each providing a irradiance profile with a horizontal illumination of the light on the surface 20 that is Gaussian or bell-shaped, so that sufficient overlap of the light distribution from one optical element 10 to the next provides the desired uniformity, as shown for example in FIGS. 4A and 4B. For purposes of illustration, six optical elements 10 are shown, but another number may be used depending on the width of surface 20. Further, the optical elements 10 are evenly spaced across the bottom of surface 20 to provide sufficient illumination. If the width of the surface 20 is W and there are N optical elements 10, then the spacing between fixtures is W/N with the end optical element 10 a distance W/2N from the edge of the surface 20. It is desirable that the light from each optical element 10 overlaps approximately one half the light distribution from each neighboring optical element. In doing so, the total light distribution can be made as uniform as possible. As an example, each optical element 10 produces an intensity distribution of the form $$I = I_0 \frac{z_0^2}{\cos^3\theta} \exp\left[-\frac{(z_0 \tan\theta \cos\phi)^2}{2w^2}\right], \quad \theta_{min} \le \theta \le \theta_{max} \tag{1}$$

as a function of vertical angle θ and polar angle ϕ. These angles are shown in FIG. 5.

The parameter $z_0$ is the distance the optical element 10 extends out from the surface 20, and w is a width parameter for the Gaussian function. This form produces an irradiance profile 42 on the surface 20 that is Gaussian in shape along the horizontal direction. The width parameter is chosen so that the irradiance from each optical element falls to just about half its peak value at the midpoint between optical elements. The overall sum will then be nearly uniform between the light fixtures and gradually fall off at the sides.

Another possible intensity distribution from a single optical element 10 takes the form $$I = I_0 \frac{z_0^2}{\cos^3\theta} \cos^2\left[\frac{(z_0 \tan\theta \cos\phi)}{w}\pi\right], \tag{2}$$

$$\text{for } \theta_{min} \le \theta \le \theta_{max} \text{ and } \left|\frac{(z_0 \tan\theta \cos\phi)}{w}\right| \le 1.$$

In this case the width parameter is chosen so that the $\cos^2$ function falls to ½ at the midpoint between fixtures. In this way the total irradiance on the surface 20 of this example of billboard illumination will be uniform between the optical elements 20. Although such forms of intensity are described, other intensity distributions may be provided.

In the example of FIGS. 4A and 4B, the output irradiance profile 42 contributes to the illumination on the surface 20 along a horizontal line from each optical element 10 shown by the dashed lines, and the sum of the overlapping profiles, shown by the solid line 43, from all the optical elements 10. The light distribution is almost, if not entirely, uniform between the optical elements and has a gradual fall off at the edges. Increasing the number of light fixtures reduces the horizontal width of the irradiance profile from each fixture and minimizes this fall off at the edges. Optionally, the number of optical elements 10 can be increased by one while maintaining the same spacing and the array can be positioned so that the two end elements are in line with the edges of the surface 20. In this way the fall off from the end elements is beyond the surface 20 and the entire surface will be substantially uniformly illuminated. This can provide irradiance variation from maximum to minimum across the surface 20 at or less than 2:1 versus a 6:1 variation from conventional metal halide lamp and nearly 8:1 from some current LED oblique illumination systems.

To provide the above described illumination distribution in the horizontal and vertical directions along a surface 20, the following equations may be used which define the curvature of the surfaces along optical element 10. Using the coordinates shown in FIG. 6A, the surfaces 16, 23, and 24 can be expressed by individual quadratic equations that take the general form $$Ay'^2 + By'z' + Cz'^2 + Dy' + Ez' = F, \tag{3}$$

where the A-F coefficients are unique for each surface. These are conic curves that can also be represented in parametric form as $$P(t) = \frac{(1-t)^2 P_0 + 2(1-t)tP_1 w_1 + t^2 P_2}{(1-t)^2 + 2(1-t)tw_1 + t^2}, \tag{4}$$

where P is a vector for the (y',z') point lying on the curve and the endpoints $P_0$=P(t=0) and $P_2$=P(t=1). The point $P_1$ in an intermediate control point and $w_1$ is a weighting factor that deforms the curve. Higher weight values cause the curve to pass closer to the control point. A weight value of 0 defines a straight line between end points $P_0$ and $P_2$.

Figure 7A:
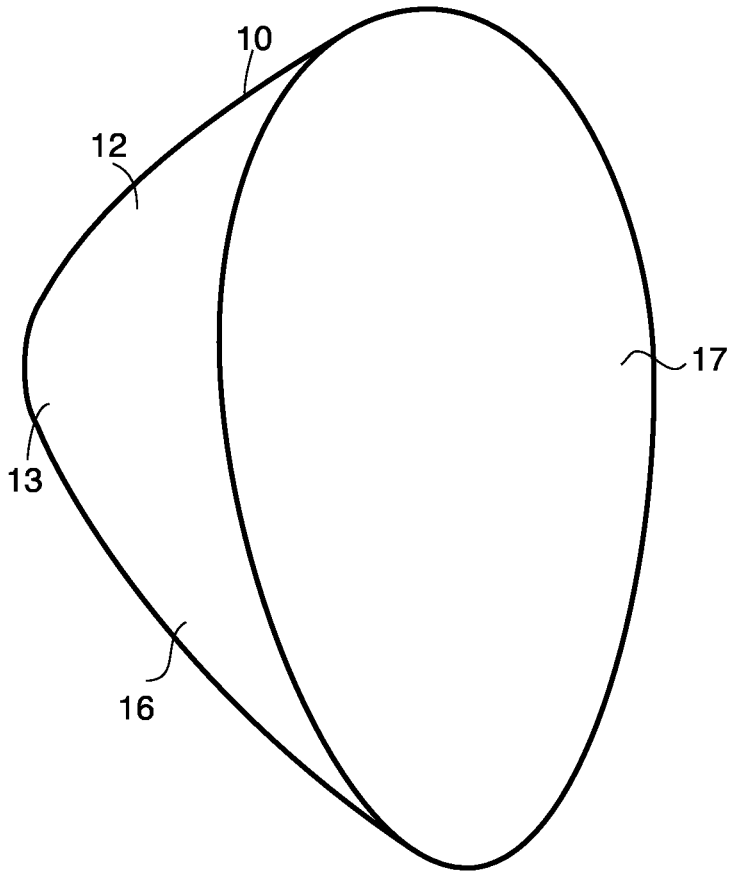
FIGS. 7A and 7B are perspective and front views, respectively, of the optical element of FIG. 1A for the curvature of surfaces of FIGS. 6A-6D.
Figure 7B:
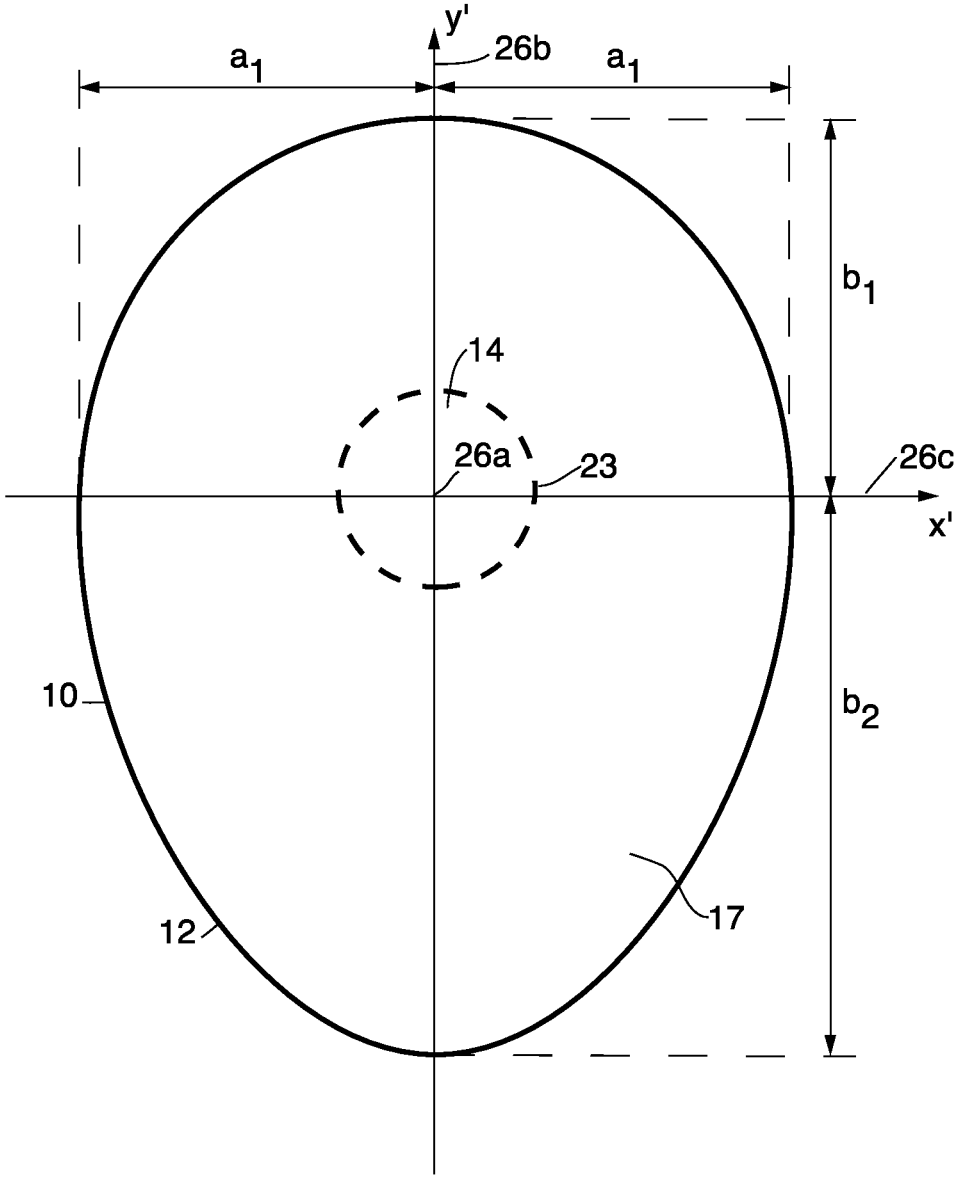

The perimeter of the output face 17 of the optical element as shown in FIG. 7B is a modified ellipse and has the equation:

$$\frac{x'^2}{a^2}\left(\frac{1}{1 + c(y' - d)}\right) + \frac{(y' - d)^2}{b^2} = 1, \tag{5}$$

where a is the semiminor axis and b is the semimajor axis. The offset parameter d is used to place one focus of the ellipse on the optical axis z'. In the example of the perimeter of output face 17 shown in FIG. 7B, values of a, b, c, and d in the above Equation (5) are 13.5, 18, 0.018, and −3.48, respectively. The endpoints $P_2$ of the outer sides 16 as defined by Equation (4) trace along this modified ellipse to sweep out the shape of the outer sides 16.

Figure 6A:
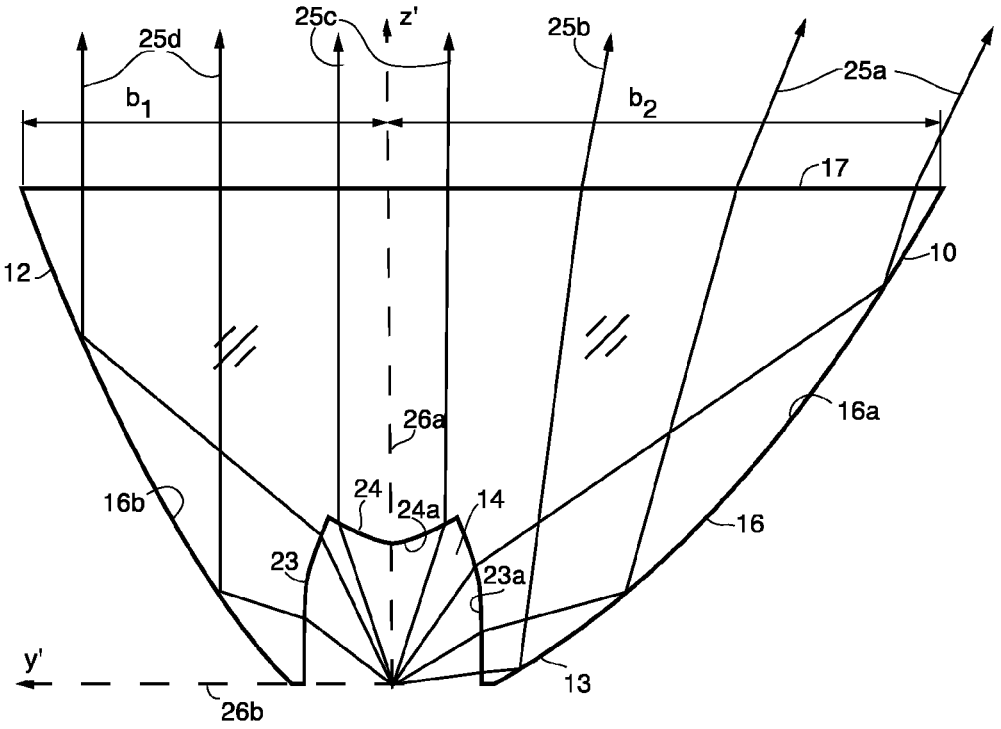
FIGS. 6A and 6B are cross-sections in the plane of the major axis and optical axis of the optical element of FIG. 1A without and with an LED, respectively, to show the light rays from a point source.
Figure 6B:
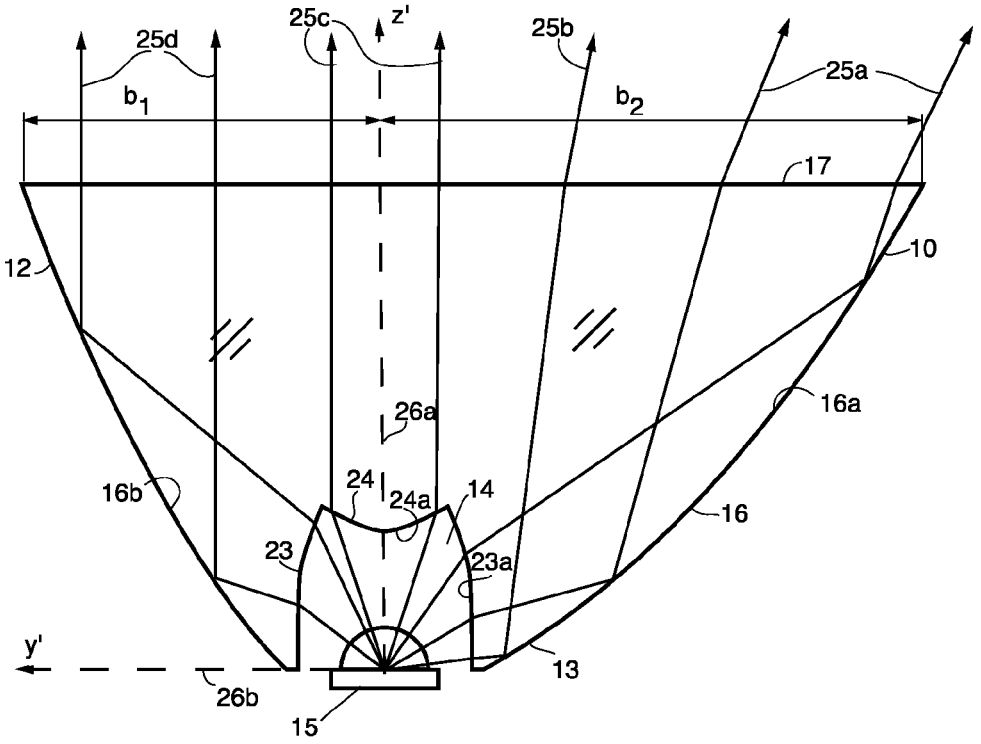
Figure 6C:
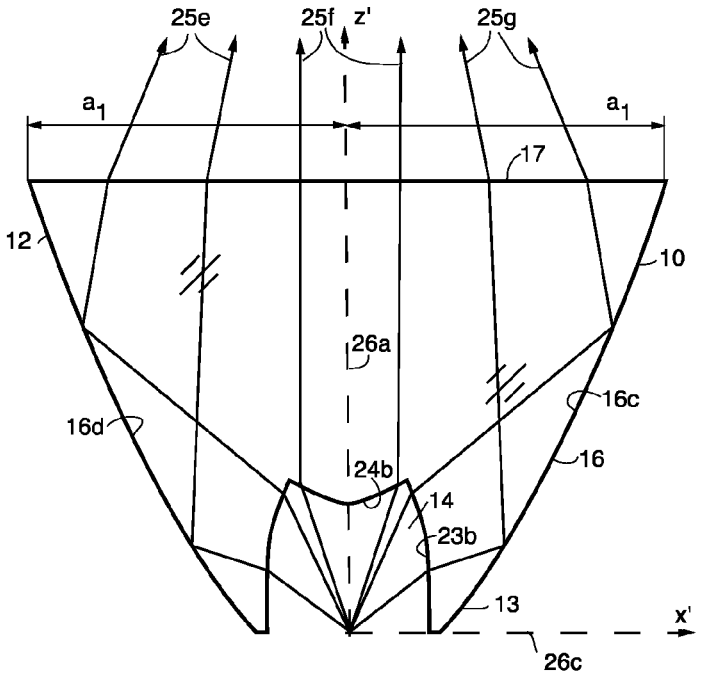
FIGS. 6C and 6D are cross-sections in the plane of the minor axis and optical axis of the optical element of FIG. 1A without and with an LED, respectively, to show the light rays from a point source.
Figure 6D:
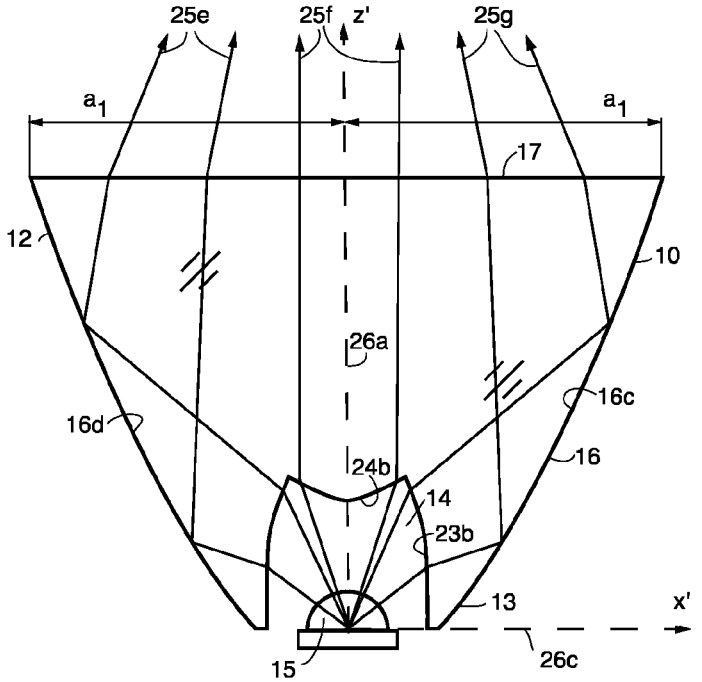

One example of optical element 10 is shown in FIG. 1A and FIGS. 6A-6D, where FIGS. 6A and 6B are cross sections of the optical element along the major axis y' and FIGS. 6C and 6D are cross sections of the optical element along the minor axis x', along with light rays 25*a*-25*g* from a point source provided by light source 15. FIGS. 7A and 7B show the optical element 10 from right perspective and front views, respectively. The intersection of the major axis y' and minor axis x' in FIG. 7B represents the optical axis z' extending perpendicular to the plane of the figure, and defines the location of the light source 15 in cavity 14 illustrated in dashed lines around optical axis z'.

The length and width of the optical element 10 are determined by the parameters $b_1$, $b_2$, and $a_1$, as best shown in FIG. 7B. In FIG. 7B, the optical element 10 is symmetric along the minor axis x' on either side about the major axis y'. The cavity 14 of the optical element 10 surrounding light source 17 as stated earlier, has the side walls 23 and central portion 24, which in this example have concave and convex surfaces 23*a* and 24*a*, respectively. Further in this example, the cavity 14 is rotationally symmetric about the optical axis z'. The side walls 23 and central portion 24 serve two distinct functions. The central portion 24 collects narrow-angle light from light source 15 and collimates it, sending it directly through the output front face 17 shown by rays 25*c* and 25*f*. It is optimized to obtain the best collimation for the light that it collects. Given the physical extent of a light source 15 provided by an LED, the best collimation will yield a beam of light that has a divergence of 1 to 2 degrees about the optical axis z'.

The side walls 23 collect the wide-angle light emitted from the light source 15 and by refraction direct it toward the outer sides 16. This light strikes the outer sides 16 at an angle beyond the critical angle and undergoes total internal reflection (TIR). The light then exits the optical element 10 through the output front face 17. The geometry of these surfaces provided by side walls 23, central portion 24, and outer sides 16 determines how the individual light rays 25*a*-*g* exit the optical element 10 and illuminate surface 20.

In the example of FIG. 1A, the optical element 10 is tilted such that the optical axis z' points toward the upper or distal portion 20*c* of surface 20, for example, at 70° above the horizontal for the surface with a maximum angle of about 75°. Outer sides 16 may be considered as having a lower side 16*a* and upper side 16*b* along the major axis y' on either side of the optical axis z'. The upper side 16*b* above the optical axis z' in conjunction with the concave surface 23*a* obtain the best collimation for the rays 25*d*, emitted from the light source 15 in the plane containing the major and optical axes. The physical extent of the light source 15 determines the minimum divergence of these rays. A larger light source 15 will give a larger divergence. A minimum divergence for these rays 25*c* and 25*d* when emitted from the light source is preferred for the following reason. Since the light source 15 and the optical element 10 are pointed toward the upper portion 20*c* of surface 20, as shown in FIG. 1A, the light distribution should fall off quickly for angles above the optical axis z' so as to minimize the light above surface 20, thus reducing wasted light and light pollution. This optimization determines the shape of the outer surface of the upper side 16*b*, the shape of side walls 23, and consequently the $b_1$ parameter for the upper portion of the optical element 10 (see FIG. 7B).

The extent of the elongation of the optical element 10 along the major axis y' in FIG. 7B is determined by the $b_2$ parameter. This parameter is chosen to provide illumination to the lower or proximal portion 20*a* of the surface 20. Since $b_2$ is greater than $b_1$, the rays 25*a* from the light source 15 that strike the outer surface of the lower side 16*a* on this half of the optical element 10 do so at more of a glancing angle than rays 25*d* (see FIGS. 6A and 6B). Thus these rays 25*a* will not be collimated and will exit the optical element 10 diverging away from the optical axis z' so as to illuminate the lower portion 20*a* of the billboard (see FIG. 1A). The curvature profile of the outer surface of the lower side 16*a* along a plane containing the major and optical axis z' is optimized to obtain the desired light distribution on the lower portion 20*a* of surface 20 which extends upwards to meet the upper portion 20*c* where the light rays 25*c* from central portion 24 fall off about a middle portion 20*b* overlapping the upper and lower portions 20*a* and 20*c*.

The width of the optical element 10 is determined by the parameter $a_1$ as shown in FIGS. 6C and 6D, and controls the spread of the light across the width of surface 20. Because $a_1$ is in general less than $b_1$ the light reflected off the outer sides 16 of the optical element 10 in the plane containing the minor and optical axes and transmitted through the front face 17 will not be collimated, as shown by the rays 25*e* and 25*g*. These rays cross the optical axis z' at various locations before striking surface 20. The value of the parameter $a_1$ determines the extent to which these rays 25*e* and 25*g* spread across the width of surface 20. Smaller $a_1$ values cause the rays 25*e* and 25*g* to spread wider. In this example, $a_1$ is selected to be smaller than $b_1$. One could also choose to make $a_1$ larger than $b_1$. If $a_1$ is selected to be larger than $b_1$ then the rays 25*e* and 25*g* in the plane containing the minor and optical axes reflecting off the sides of the optical element 10 would not cross the optical axis z' and would continue to diverge toward the surface 20. This would make the optical element 10 larger containing a larger volume of material. The surface curvature profile of the outer sides 16 in the plane of the minor and optical axes is optimized to provide the desired distribution across the width of the surface 20.

The shape of the flat front face 17 of optical element 10 is governed by one of a number of possible mathematical expressions, one of which was given in Equation (5) above. In general it is a tear-drop or egg (e.g., oblong) shape and is chosen in combination with the parameters $b_1$, $b_2$, and $a_1$ to produce the desired light distribution from optical element 10. The surface curvature profiles of the outer sides 16 follow the top edge of front face 17 and base 13 to form a smooth, continuous shape.

An example of the (y', z') points from Equation (4) that define the surfaces 16*b*, 23*a*, 24*a*, and 16*a* is given in the table below where the dimensions are millimeters.

| | |
|---|---|
| 16b | $P_0$ = (3.96, 0) |
| | $P_1$ = (9.33, 5.36), $w_1$ = 0.945 |
| | $P_2$ = (14.52, 19.38) |
| 23a | $P_0$ = (3.46, 0) |
| | $P_1$= (3.44, 4.18), $w_1$ = 4.19 |
| | $P_2$ = (2.51, 6.49) |
| 24a | $P_0$ = (0.1, 5.51) |
| | $P_1$ = (1.77, 5.77), $w_1$ = 0.34 |
| | $P_2$ = (14.52, 19.38) |
| 16a | $P_0$ = (−3.96, 0) |
| | $P_1$ = (−13.81, 5.36), $w_1$ = 0.945 |
| | $P_2$ = (−21.48, 19.38) |

The parameter $a_1$=13.65 mm, $b_1$=14.52 mm, and $b_2$=21.48 mm.

In summary, as shown in FIGS. 1A, 6A, and 6B, outer sides 16 may be considered as having a lower side 16*a* and upper side 16*b* along the major axis y' on either side of the optical axis z'. Side walls 23 may have concave surfaces 23*a* along the major axis y', and central portion 24 may have convex surfaces 24*a* along the major axis y'. The curvature of the interior surfaces along the lower side 16*a* of outer sides 16 reflects light, via front face 17, received from concave surfaces 23*a* to the lower side 20*a* of surface 20 of FIG. 1A (as denoted by multiple directions of non-collimated light rays 25*a*). The curvature of the surfaces along the upper side 16*b* of outer sides 16 reflects light, via front face 17, received from concave surfaces 23*a* to the upper portion 20*c* (along a lower portion thereof of intermediate portion 20*b* between portions 20*a* and 20*c*) of surface 20 of FIG. 1A (as denoted by light rays 25*d*), and curvature along central portion 24 also directs light to upper portion 20*c* of surface 20 of FIG. 1A (as denoted by light rays 25*c*). Both upper side 16*b* and central portion 24 substantially or entirely collimate light in a direction along optical axis z'. Thus lower side 16*a* directs light away from the optical axis z' as the optical axis z' extends away from front face 17. This controls the output illumination distribution of optical element 10 along the height of surface 20.

As shown in FIGS. 6C, and 6D, outer sides 16 may be considered as having a right side 16*c* and left side 16*d* along the minor axis x' on either side of the optical axis z'. Side walls 23 may have concave surfaces 23*b* along the minor axis x', and central portion 24 may have convex surfaces 24*b* along the minor axis x'. The curvatures along right and left sides 16*c* and 16*d* are preferably symmetric and each directs light, via front face 17, received from concave surface 23*b* towards the optical axis z' as the optical axis z' extends away from front face 17 in a direction toward surface 20, as shown in FIGS. 6C and 6D (denoted by light rays 25*e* and 25*g*, respectively). Convex surface 24*b* substantially or entirely collimates light in a direction along optical axis z' (as denoted by light rays 25*f*). Concave surfaces 23*a* and 23*b* and convex surfaces 24*a* and 24*b* are also preferably symmetric. This controls the output illumination distribution of optical element 10 along the width of surface 20.

Figure 8A:
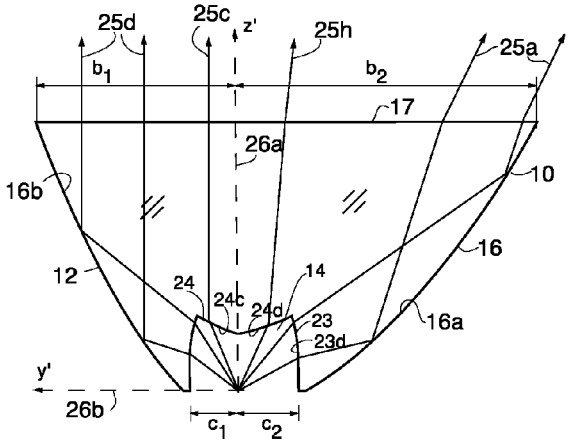
FIGS. 8A, and 8B are views similar to FIGS. 6A, and 6B, respectively, of an optical element in accordance with another example of the present invention.
Figure 8B:
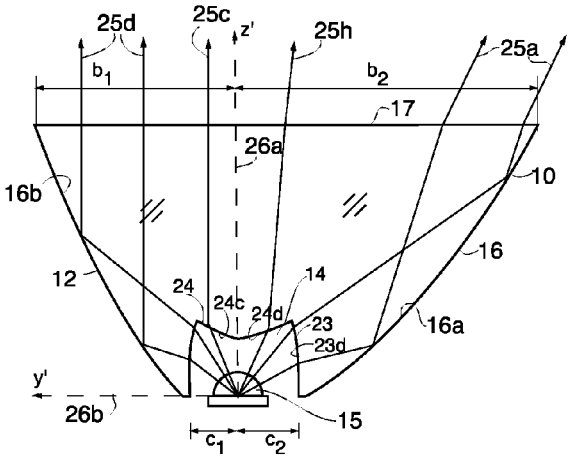
Figure 8C:
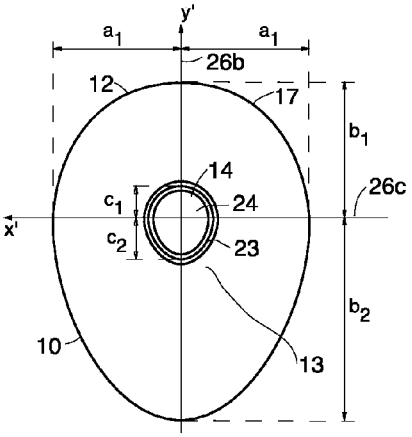
FIG. 8C is a bottom view of the optical element of FIGS. 8A and 8B.

The above example uses a cavity 14 that is rotationally symmetric about the optical axis z'. Just as the outer sides 16 are elongated to spread the light distribution down the surface of the billboard, so too can the cavity as shown in FIGS. 8A, 8B, and 8C. This example is identical to the previous example, except for central portion 24 has an upper portion (along the major axis y' above the optical axis z') having half of a convex surface 24*c* identical to the corresponding half of convex surface 24*a*, and a lower portion (along the major axis y' below the optical axis z') having a surface 24*d* with curvature that refracts light received from light source 15 away from optical axis z' as non-collimated light rays 25*h* towards the intermediate portion 20*b* of surface 20.

Figure 9:
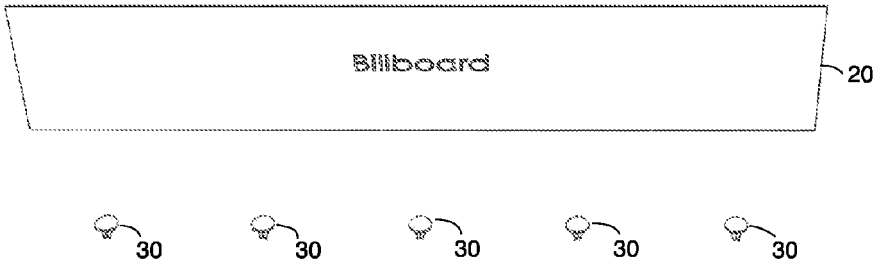
FIG. 9 is a block diagram showing an example layout of apparatuses of the present invention each having a single optical element and light source for use with same to direct oblique illumination upwards towards a surface, such as a billboard, where each of the apparatuses represent a one dimensional array of the optical elements of the present invention.
Figure 10:
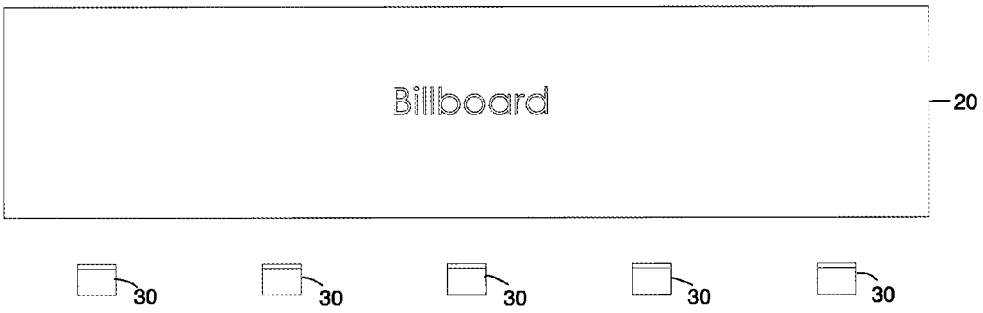
FIG. 10 is a block diagram showing a example layout of apparatuses of the present invention each having multiple optical elements and light sources to direct oblique illumination upwards towards a surface, such as a billboard.
Figure 11:
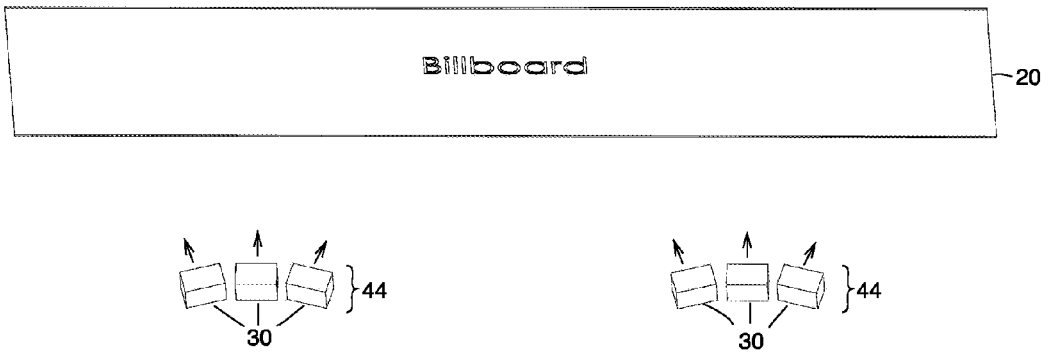
FIG. 11 is a block diagram showing an example layout of apparatuses of the present invention each having multiple optical elements and light sources to direct oblique illumination upwards towards a surface, such as a billboard, in which groups of apparatuses are disposed in banks which are separated a distance from each other.

Referring to FIGS. 9, 10, and 11, different arrays of apparatuses 30 are shown with respect to a surface 20 shown as a billboard. FIG. 9 shows a one-dimensional array of apparatuses 30 having a single optical element such as shown for example earlier in FIG. 1B. The apparatuses are evenly spaced adjacent to each other, have identical optical elements 10 and illumination sources 15, disposed the same distances 22*a* and 22*b* from surface 20, and have their respective front faces 17 tilted the same to provide oblique illumination over the viewing angles (FIG. 2). FIG. 10 shows a one-dimensional array of apparatuses 30 having multiple optical elements in one or two dimensional arrays, as shown in FIGS. 1E and 1F. The operation of optical elements 10 in such apparatus 30 may be the same as described earlier in connection with FIGS. 4A and 4B. Optionally such optical elements may be randomly oriented. The apparatuses 30 are evenly spaced adjacent to each other, have identical optical elements 10 and illumination sources 15, disposed the same distances 22*a* and 22*b* from surface 20, and have their respective front faces 17 tilted the same to provide oblique illumination over the viewing angles (FIG. 2).

FIG. 11 shows the same apparatus as shown in FIG. 10, but grouped into banks 44 evenly spaced adjacent to each other. In each bank 44 of three apparatuses 30, the center bank points directly toward the surface 20. The outer two banks on each fixture are splayed outward at different directions towards surface 20. Each points slightly outward toward the side of its bank so that banks may be spaced farther apart and still provide the desired uniformity across the surface being illuminated. The general direction of illumination along the height and width of each apparatus 30 of bank 44 are shown by arrows in FIG. 11. Optionally, each apparatus 30 in FIGS. 10 and 11 may represent multiple apparatus 30 integrated into a single fixture.

In each of FIGS. 9-11, the illumination from each adjacent apparatus 30 overlaps to at least substantially uniformly illuminate surface 20. Each single one of the apparatuses 30 of FIGS. 10 and 11 may have their optical elements operate in the same manner as described earlier in connection with FIGS. 4A and 4B, in which apparatus 30 at the ends of every two adjacent apparatuses 30 similarly overlap each other to provide uniform illumination.

Figure 12A:
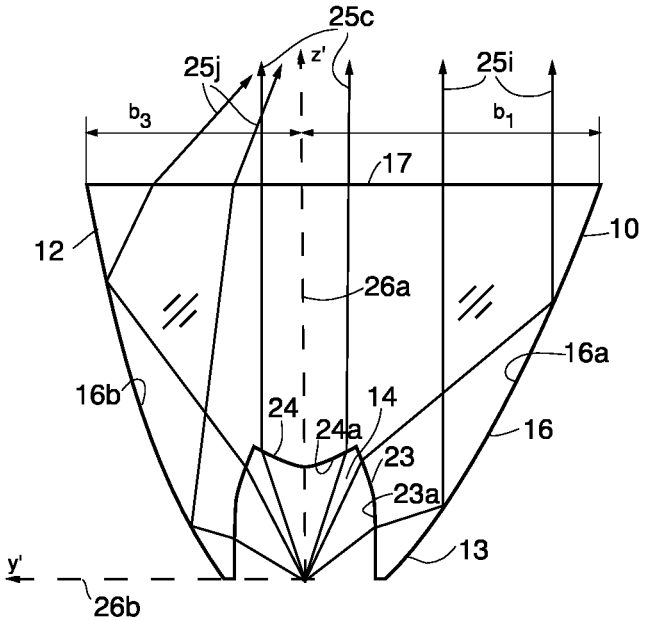
FIGS. 12A and 12B are views similar to FIGS. 6A and 6B, respectively, of an optical element in accordance with a further example of the present invention.
Figure 12B:
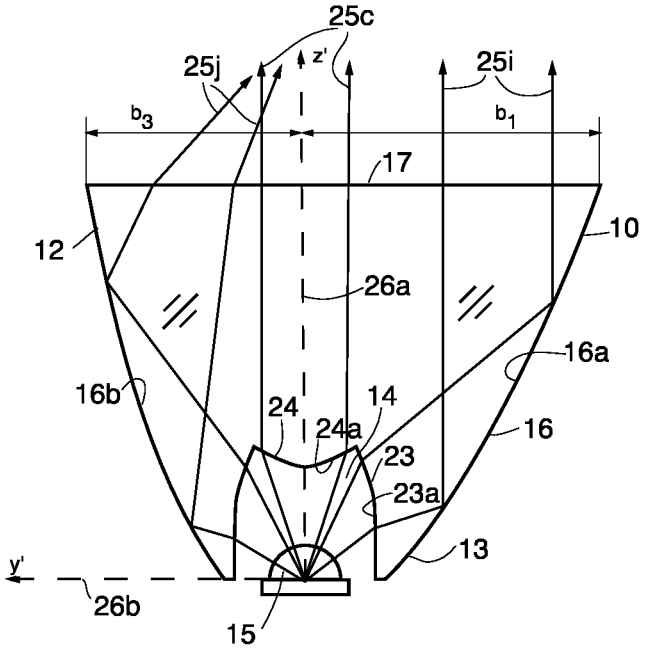
Figure 13:
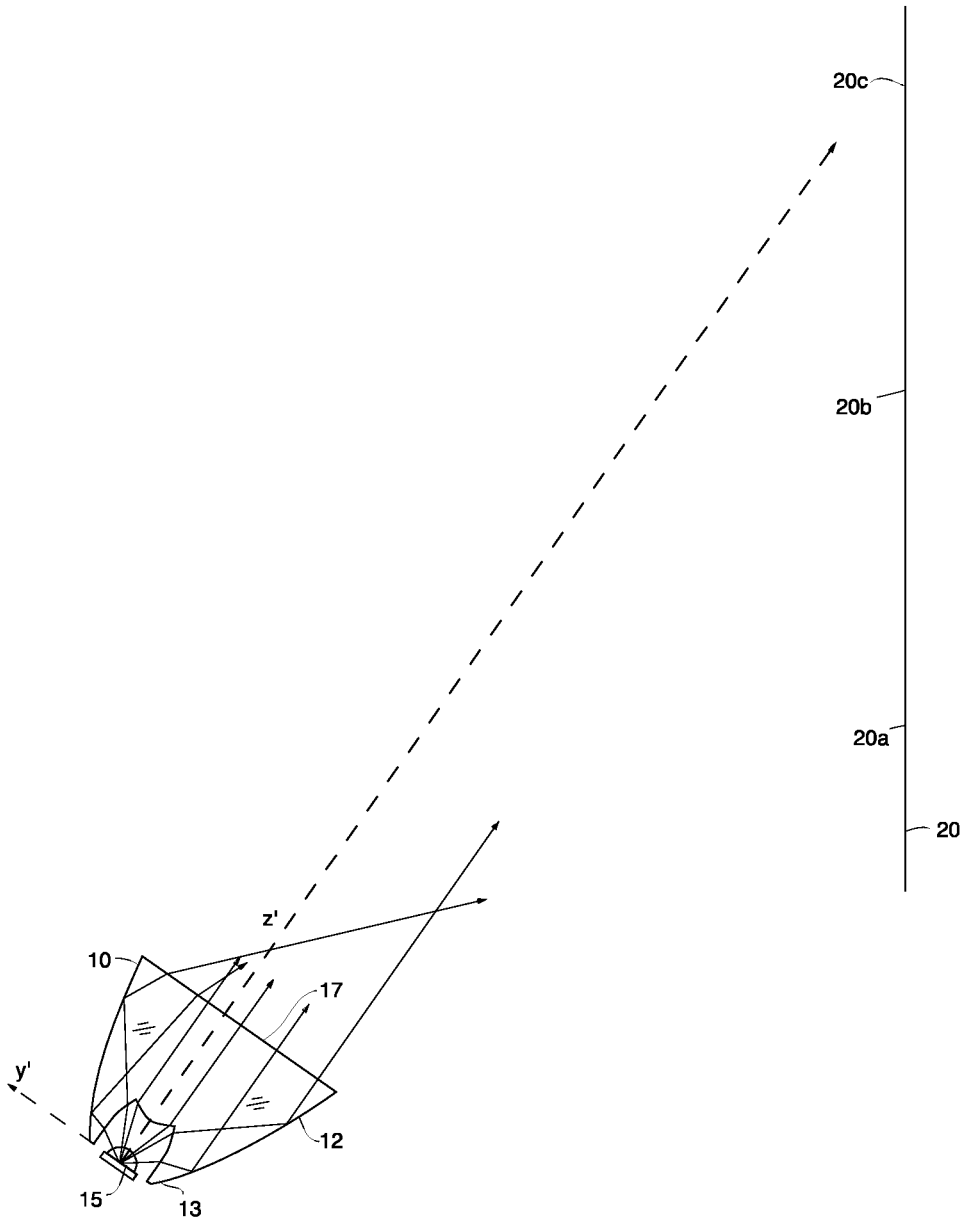
FIG. 13 is a cross-sectional view similar to FIG. 1A for the optical element of FIGS. 12A and 12B.

A further example of the optical element is shown in FIGS. 12A, 12B, and 13. The lower side 16*a* of the outer sides 16 is kept at the dimension $b_1$ and the upper dimension is at a dimension $b_3$ where $b_3$ is less than $b_1$. Keeping the lower dimension at $b_1$ means that the lower side 16*a* has surface curvature reflecting light received via side walls 23 into collimated light along the optical axis z' directed toward the upper or distal portion 20*c* of surface 20 (denoted by light rays 25*i*). Reducing $b_3$ causes the upper side 16*b* of the outer sides 16 to have surface curvature reflecting light received, via side walls 23, to be directed toward the lower or proximal portion 20*a* of surface 20 (in multiple directions denoted by light rays 25*j*). The side walls 23 and central portion 24 have surfaces the same as described earlier in FIGS. 6A-6D. This reduces the overall size of the optical element 10 from the earlier examples of FIGS. 6A-6D and 8A-8C.

Optionally, a diffuser may be formed directly into front face 17 of optical element 10 to aid in spreading the light across surface 20 and homogenizing the light, or such diffuser may be a distinct element separated by a small distance from front face 17 to provide such function. For example, window 37 of FIG. 1B may represent such diffuser spaced from or mounted to front face 17.

Although the above applications relate to billboard illumination, any vertical surface requiring oblique illumination can utilize the optical elements 10 and apparatuses 30 where avoiding obstructing the view from the front thereof is desired, such as to illuminate paintings disposed along a wall, to illuminate walls or ceilings of a room, or for architectural illumination. Further, optical elements 10 and apparatuses 30 may be disposed below spaced from the front of surface 20 for upwards oblique illumination, as shown in the figures, but may be disposed in other orientations, such as above and spaced from the top of surface 20 for downwards oblique illumination, or along a side edge for sideways oblique illumination.

From the foregoing description, it will be apparent that an optical element providing at least substantially uniform oblique illumination and apparatuses and methods using same have been provided. Variations and modifications of the herein described optical element, apparatuses, and methods and other applications for the invention will undoubtedly suggest themselves to those skilled in the art. Accordingly, the foregoing description should be taken as illustrative and not in a limiting sense.

The invention claimed is:

1. An optical element for illuminating a surface at an oblique angle comprising:

a body having a base with a cavity for receiving a light source, a front face, and outer sides providing total internal reflection;

said body is asymmetrically shaped having an optical axis extending through said base and said front face, and minor and major axes orthogonal to each other and to said optical axis in which said body is elongated along said major axis;

said body is positionable by tilting said front face so that said optical axis is at an oblique angle with respect to a target surface to be illuminated, in which said front face extends along said major and minor axes and said front face along said major axis faces a dimension aligned with a height of the target surface; and curvature of surfaces along said cavity and said outer sides are selected to enable said body to output illumination from said front face having a distribution upon the target surface extending along the height of the target surface and along at least a portion of a width of the target surface, in which said output illumination from said body has increased intensity with increasing height along said target surface to provide at least substantially uniform illumination of said target surface along at least said height of said target surface.

2. The optical element according to claim 1 wherein said distribution extends along entire width of said target surface to provide at least substantial uniform illumination of an entirety of said target surface.

3. The optical element according to claim 1 wherein a plurality of ones of said body are provided which are adjacently disposed in a direction along the width of the target surface to enable said distribution of said output illumination upon said target surface from adjacent disposed ones of said body to at least partially overlap and provide at least substantial uniform illumination of an area of the target surface over a larger width of the target surface than can be provided by a single one of said body.

4. The optical element according to claim 3 wherein said distribution along the width of the target surface is Gaussian or bell-shaped, and said distribution of the output illumination upon said target surface from one of said adjacently disposed ones of said body falls to approximately one-half the peak value to overlap the one-half point of the distribution of the output illumination upon the target further of the next adjacently disposed ones of said body to provide at least substantial uniform illumination along said area of said target surface.

5. The optical element according to claim 3 wherein said larger width is over the entire width of said target surface to illuminate with at least substantial uniform illumination of an entirety of said area of said target surface.

6. The optical element according to claim 1 wherein said output illumination from said body has increased intensity along different portions at increasing height along said target surface in which adjacent said portions partially overlap.

7. The optical element according to claim 1 wherein said curvatures of surfaces along said cavity are provided along side walls and a central portion of said cavity, in which light received by said body via said central portion is directed to said front face, and light received by said body via said side walls is reflected by said outer surfaces by total internal reflection to said front face.

8. The optical element according to claim 1 wherein said body is positionable spaced vertically and horizontally from a bottom or top of said target surface to enable said distribution of said output illumination at said oblique angle to be provided to said target surface upwards or downwards, respectively.

9. The optical element according to claim 1 wherein said optical axis extends away from said front face;

said outer sides have a first side and second side, in which said second side is closer to said target surface than said first side;

said first side has curvature along said major axis providing light from said light source in a direction towards a distal portion of said distribution of said output illumination along said target surface;

said second side has curvature along said major axis providing light from said light source in a direction towards a proximal portion of said distribution of said output illumination along said target surface; and said central portion has curvature along said major axis for providing light from said light source in a direction towards an intermediate portion of distribution of said output illumination along said target surface between said distal and proximal portions of said target surface, in which said distal portion of said distribution along said target surface is provided with more intensity than said intermediate portion of said distribution along said target, said intermediate portion of said distribution along said target surface is provided with more intensity than said proximal portion of said distribution along said target surface so as to enable said body to output illumination from said body having increased intensity with increasing height along said target surface.

10. The optical element according to claim 1 wherein said optical axis extends away from said front face;

said outer sides have a first side and second side, in which said second side is closer to said target surface than said first side;

said first side has curvature along said major axis providing light from said light source in a direction towards a distal portion of said distribution of said output illumination along said target surface;

said second side has curvature along said major axis providing light from said light source in a direction towards a proximal portion of said distribution of said output illumination along said target surface; and said central portion has a first portion of curvature along said major axis for providing light from said light source in a direction towards an intermediate portion of distribution of said output illumination along said target surface between said distal and proximal portions of said target surface and a second portion of said curvature along said major axis providing light from said light source in a direction towards at least a portion of said proximal portion of distribution of said output illumination, in which said distal portion of said distribution along said target surface is provided with more intensity than said intermediate portion of said distribution along said target, said intermediate portion of said distribution along said target surface is provided with more intensity than said proximal portion of said distribution along said target surface so as to enable said body to output illumination from said body having increased intensity with increasing height along said target surface.

11. The optical element according to claim 1 wherein said optical axis extends away from said front face;

said outer sides have a first side and second side, in which said second side is closer to said target surface than said first side;

said second side has curvature along said major axis providing light from said light source in a direction towards an intermediate portion of said distribution of said output illumination along said target surface;

said first side has curvature along said major axis providing light from said light source in a direction towards a proximal portion of said distribution of said output illumination along said target surface; and said central portion has curvature along said major axis for providing light from said light source in a direction towards a distant portion of distribution of said output illumination along said target surface between said distal and proximal portions of said target surface, in which said distal portion of said distribution along said target surface is provided with more intensity than said intermediate portion of said distribution along said target, said intermediate portion of said distribution along said target surface is provided with more intensity than said proximal portion of said distribution along said target surface so as to enable said body to output illumination from said body having increased intensity with increasing height along said target surface.

12. The optical element according to claim 1 wherein said central portion has curvature along said minor axis for collimating light, via said front face, to said target surface, said outer surfaces have curvature along said minor axis to reflect light received from said side walls, via said front face, to said target surface in a direction towards said optical axis as said optical axis extends away from front face so as to provide said distribution of illumination along said portion of the width of said target surface.

13. The optical element according to claim 1 wherein said light source is an LED.

14. The optical element according to claim 1 wherein said target surface is a billboard sign.

15. The optical element according to claim 1 wherein said target surface is one of flat or curved.

16. The optical element according to claim 1 wherein said body is in a unit having said light source in said cavity of said body.

17. The optical element according to claim 1 wherein said body is part of a unit, and said unit has one or more ones of said body and each of said one or more ones of said body has a different light source, in which each of said one or more ones of said body provides said distribution of output illumination along successively different portions along the width of said target surface to be illuminated.

18. The optical element according to claim 17 wherein said distribution of said output illumination along said successively different portions overlap each other along the width of the target surface to provide substantial uniform illumination of said target surface.

19. The optical element according to claim 17 wherein a plurality of ones of said unit are at a distance from one edge of the target surface, adjacent ones of said plurality of ones of said unit are spaced apart from each other so that illumination from adjacent ones of said plurality of one of said unit provide light along a different section of said target surface to provide substantial uniform illumination of said target surface.

20. The optical element according to claim 19 wherein each of said plurality of units is oriented to provide light along a common direction towards said target surface.

21. The optical element according to claim 19 wherein one or more of said plurality of units are oriented to provide light along a different direction towards said target surface.

22. The optical element according to claim 1 wherein said body is part of a unit, and said unit having a plurality of ones of said body and each of said one or more ones of said body has a different light source in one or two dimensional array.

23. The optical element according to claim 1 wherein said height and width of the target surface are reversed and said body is positioned spaced from a side edge of the target surface so that said front face along said major axis faces said dimension aligned with the width of the target surface to enable said distribution of said output illumination at said oblique angle to be provided sideways to said target surface.

24. The optical element according to claim 1 further comprising a diffuser which is one of formed along said front face or provided as a separate element for spreading output illumination from said front face to said target surface.

25. An apparatus for providing illumination to a surface at an oblique angle comprising:

one or more units, each of said units having at least one body, and a light source disposed in a cavity at a base of said body; and said body having an output end, and outer curved sides between said base and said output end, said output end having a front, in which said outer sides meet said output end at a smoothly continuous planar curved edge along said front, and said front is disposed at an oblique angle with respect to a surface to be illuminated, in which said body is asymmetrically shaped oblong along at least said output end of said body to direct light along at least a dimension of said surface.

26. The apparatus according to claim 25 wherein said one or more units represent a plurality of said units disposed with respect to said surface so that the combination of illumination from said units illuminates an entirety of said surface.

27. The apparatus according to claim 25 wherein said body is asymmetrically shaped by having an optical axis extending through said base and said front, and minor and major axes orthogonal to each other and to said optical axis, in which said body is elongated along said major axis to provide said body which is shaped oblong at said output end.

28. A method for providing illumination to a target surface at an oblique angle comprising the steps of:

providing at least one asymmetrically shaped body which is oblong along at least an output end of said body, said body having outer curved sides between a base and an output end of the body, in which said outer sides meet said output end at a smoothly continuous planar curved edge along a front of the body, and has a cavity along said base for a light source to provide light within said cavity; and positioning said body at a distance from one edge of a target surface so that said front face of said body is tilted with respect to said target surface and provides an unobstructed view of the target surface from at least a front of the target surface, and said body directs light from said light source along at least one dimension of said target surface.

29. The method according to claim 28 wherein said one dimension represents a height of said target surface, and said method further comprises the step of:

selecting curvatures of surfaces along said cavity and said sides of said body to output illumination from said front face having a distribution upon the target surface extending along the height of the target surface and along at least a portion of a width of the target surface, in which said output illumination from said body has increased intensity with increasing height along said target surface to provide substantial uniform illumination of said target surface along at least said height of said target surface.

30. The method according to claim 29 further comprising the step of extending said distribution of said output illumination along entire width of said target surface to provide substantial uniform illumination of an entirety of said target surface.

31. The method according to claim 29 further comprising the step of providing a plurality of ones of said body which are adjacently disposed in a direction along the width of the target surface to enable said distribution of said output illumination upon said target surface from adjacent disposed ones of said body to overlap and provide substantial uniform illumination along the width and height of said target surface.

32. An apparatus providing illumination to a surface at an oblique angle comprising:

a body having a front face with a smoothly continuous planar curved outer edge, and a cavity for a light source to provide light within said cavity, wherein said body is asymmetrically shaped to be oblong at least at said front face;

said body being positionable at a distance from one edge of a surface so that said front face of said body is tilted with respect to said surface to provide an unobstructed view of the surface from at least a front of the surface; and said body outputs illumination from said front face upon the surface extending along a first dimension of the surface and along at least a portion of a second dimension of the surface orthogonal to said first dimension of the surface in which said illumination from said body has increased intensity with increasing distance from the surface along said first dimension of the surface to provide at least substantially uniform illumination of said surface along at least said first dimension of said surface.

33. The apparatus according to claim 32 wherein said body has outer sides providing total internal reflection, an optical axis extending through said cavity and said front face, and minor and major axes orthogonal to each other and to said optical axis, in which said front face extends along said major and minor axes, said body is elongated along said major axis to provide said body which is asymmetrically shaped oblong with respect to said optical axis along at least an end of the body having said front face.

34. The apparatus according to claim 32 further comprising a diffuser which is one of formed along said front face or provided as a separate element for spreading said output illumination from said front face to said surface.

* * * * *